US005637825A

United States Patent [19]

Glenning

[11] Patent Number: 5,637,825

[45] Date of Patent: Jun. 10, 1997

[54] CONTROL LINE SPOOL

[75] Inventor: Daniel M. Glenning, Newport, R.I.

[73] Assignee: The United States of America as represented by the Secretary of the Navy, Washington, D.C.

[21] Appl. No.: 587,413

[22] Filed: Jan. 17, 1996

[51] Int. Cl.[6] ..... F42B 19/10; F41G 7/32

[52] U.S. Cl. ..... 114/21.1; 89/1.811; 244/3.12; 114/253

[58] Field of Search ..... 114/20.1, 21.1, 114/254; 89/1.801, 1.811; 244/3.12; 242/118.4, 128–130, 159, 167, 171, 172

[56] References Cited

U.S. PATENT DOCUMENTS

| | | | |
|---|---|---|---|
| 3,158,124 | 11/1964 | Chevillon | 114/21.1 |
| 3,565,028 | 2/1971 | Hancks et al. | 114/20.1 |
| 3,613,618 | 10/1971 | Gruber | 114/21.1 |
| 3,613,619 | 10/1971 | De Nobel et al. | 114/21.1 |
| 3,645,469 | 2/1972 | Fischer et al. | 242/118.4 |
| 3,703,874 | 11/1972 | Lemieux | 114/21.1 |
| 3,831,879 | 8/1974 | Miller et al. | 242/129 |
| 5,022,603 | 6/1991 | Maree et al. | 242/167 |
| 5,100,078 | 3/1992 | Clark | 242/171 |
| 5,189,253 | 2/1993 | LeCompte | 102/504 |
| 5,385,319 | 1/1995 | Schotter | 244/3.12 |
| 5,419,512 | 5/1995 | Holzschuh et al. | 244/3.12 |

*Primary Examiner*—Michael J. Carone
*Assistant Examiner*—Matthew J. Lattig
*Attorney, Agent, or Firm*—Michael J. McGowan; James M. Kasischke; Prithvi C. Lall

[57] ABSTRACT

A control line deployment device useable in an underwater vehicle including a stator positioned at an aft end of an underwater vehicle having a spool bucket formed therein with an entrance opening at an aft end of the stator in communication with the spool bucket. The control line spool is slidably disposed in the spool bucket with a control line in communication with the underwater vehicle wound upon the control line spool. The control line is deployable from the control line spool by extension through the entrance opening. Access to the control line spool for its replacement is readily provided and made possible by a removable cover positioned and releasably fitted onto the entrance opening at the aft end of the stator in communication with the spool bucket. The control line deployment device of the invention facilitates installation and replacement of the spool in an underwater vehicle without requiring substantial disassembly of the underwater vehicle and without the need for cumbersome and costly infrastructure in the launch vessel.

8 Claims, 1 Drawing Sheet

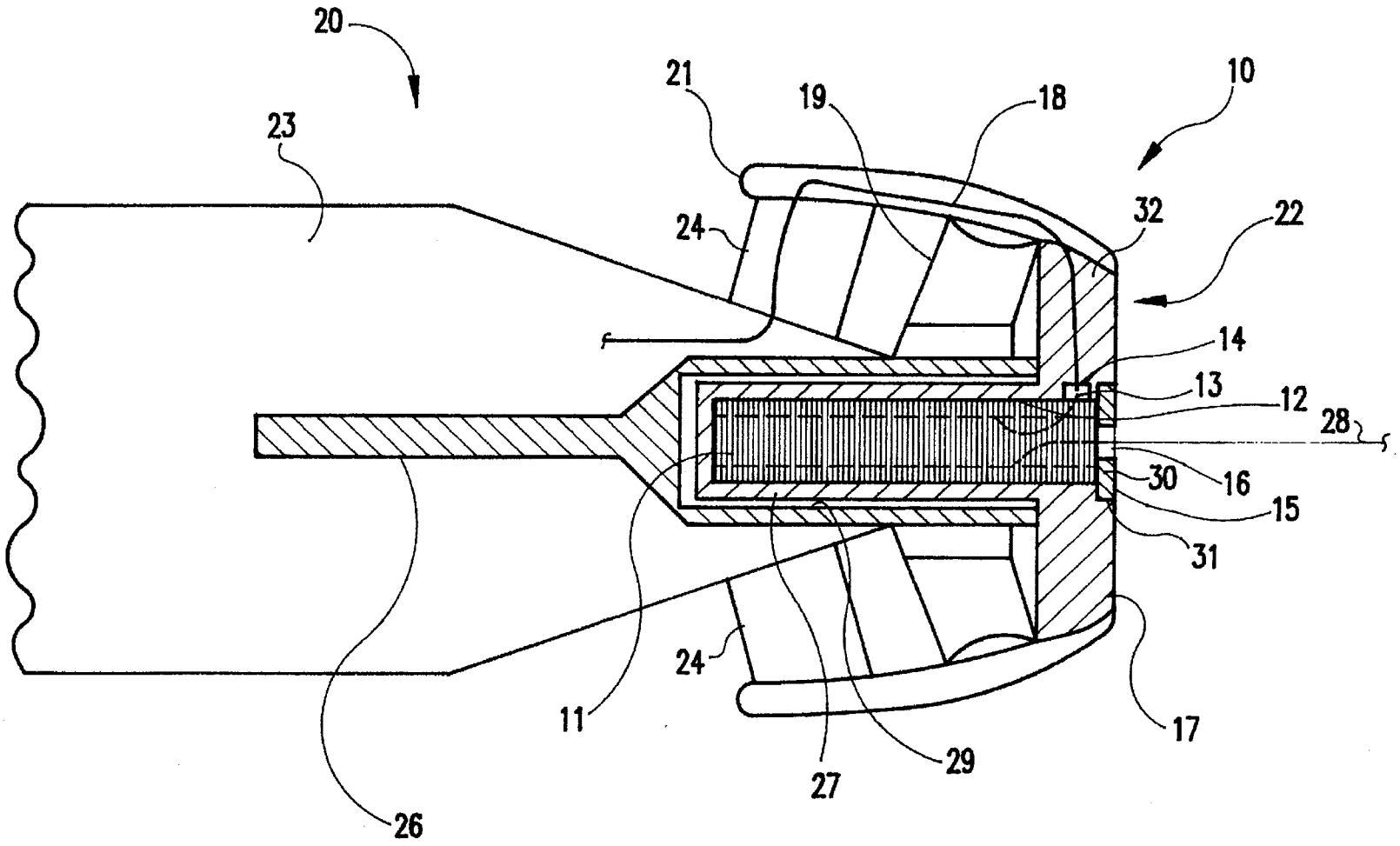
FIG.

CONTROL LINE SPOOL

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to a control line spool for an underwater vehicle that is integrated into the propulsor of the underwater vehicle to facilitate installation and replacement of the spool without necessitating drastic disassembly of the vehicle.

(2) Description of the Prior Art

Underwater vehicles, such as certain underwater missiles, are customarily designed to perform specific functions. Ordinarily, underwater missiles, such as torpedoes, are launched from an underwater vessel, such as a submarine, having launch tubes within which the torpedoes are loaded immediately prior to the launching operation. When the torpedo is fired, it leaves the tube and follows a trajectory calculated to bring it into the proximity of its intended target. Underwater launching of a self-propelled torpedo is relatively simple, initial propulsion by water impulse being sufficient to easily clear the torpedo from the launching vessel.

As discussed in U.S. Pat. No. 3,158,124 to Chevillon, a number of different forms of guidance apparatus are known by which a torpedo, once launched, may be caused to follow a variable path, such as varied in accordance with changes in position of an acquired target as a result of evasive maneuvers taken by the target in an attempt to elude the torpedo.

One proven form of guidance system for an underwater missile embodies a control line, one end of which is attached to the underwater missile, e.g., a torpedo, and the other end of which is located at the launching vessel's control station, with the intermediate length of the control line physically extending between the torpedo and launch vessel. In this control line guided torpedo concept, control signals are transmitted from the mother or launch vehicle to the torpedo through the control line to bring about variations in the position of one or more of its on board hydrodynamic control surfaces (e.g., fins), to steer the torpedo. The arrangement is such that a supply reel or spool is stored on board either the torpedo or the launch vessel, or partly on both, and the control line is payed out, i.e., unwound, from the spool(s) as the torpedo progresses through the water. As either or both the launch vehicle or torpedo move in the water the control line is freely payed out and lays substantially motionless in the water so that there is practically no strain thereon. The unreeling control line extending between the launch vessel and torpedo permits the transmittal thereover of command signals which serve to guide or redirect the torpedo to its target.

While the arrangement in which the control line trails the torpedo during its passage through the water has numerous advantages, a problem exists in the installation and replacement of the supply spool of control line located aboard the torpedo. This disadvantage has not heretofore been satisfactorily addressed and overcome.

Prior methods of replacing wire guidance spools located aboard the underwater vehicles require major disassembly of the structure of the underwater vehicles, such as a torpedo, to provide access to the control line spool to allow its removal and replacement with a fresh spool. In one implementation of this prior method, entire sections of the hull of the torpedo, which typically are bolted together, must be disassembled from one another to enable access to the control line spool such that it might be removed from the torpedo. The weight and size of these sections in this prior method, also require accommodating a large infrastructure to support the technique (e.g., cranes, dollies, load and handling, lash down strap, and so forth). It is highly undesirable to dedicate the very confined space offered by a typical submarine to warehouse such infrastructure. Thus, this prior method is very difficult to employ, from a practical standpoint. Also, the infrastructure is costly to develop and/or retrofit into existing vessels.

Particular variations of the prior technique are exemplified. by:

U.S. Pat. No. 3,158,124 to Chevillon discloses an apparatus for launching an underwater missile such as a torpedo from a surface vessel. A guidance wire is wound on a spool paid out from a sabot which detaches from a torpedo upon firing. Thus, the wire is unwound from its reel remotely from the torpedo.

U.S. Pat. No. 3,565,028 to Hancks et al. discloses a torpedo having a cable coiled on the exterior of a shroud. The shroud encircles the propellers which is articulated on a ball and socket joint to steer the torpedo, and to serve as a reel for carrying the long cable. Holddown fingers which keep the coiled cable in place, are scuttled a measured time after launch. This requires the torpedo to straighten the wire against hydrodynamic drag.

U.S. Pat. No. 3,613,618 to Gruber discloses a protective sheath arrangement for a control wire for a torpedo. The control wire is coiled on a spool carried in the torpedo tube. The arrangement comprises a sheath through which the control wire extends, the length of the sheath being less than the range of the torpedo and equal to the distance from the boat through which the control wire is to be protected. The sheath and the length of control wire surrounded thereby being in a coil prior to launching of the torpedo. One end of the sheath is secured to the torpedo tube, there being a rupturable connection for securing the outer end of the sheath to the torpedo. Consequently, the torpedo, after reaching the above-indicated distance from the boat, will tear itself free from the sheath. In this way, the control wire is protected during its run by the sheath at locations near the boat, where needed, while savings in space are realized by eliminating the sheath usage at farther removed locations of the control wire from the boat.

U.S. Pat. No. 3,613,619 to de Nobel et al. describes a wire-guided torpedo payout coil. The wire-guided torpedo coil apparatus is described as having a container having an exit opening, and a coil of insulated wire disposed within the container with a portion of the wire disposed within the container with a portion of the wire extending through said exit opening, and voids within the coil of wire are filled with a conductive adhesive. The adhesive provides desirable electrical conditions and does not unduly or nonuniformly restrain the wire as it is payed out from the torpedo. The payout apparatus is generally described as being mounted in the aft portion of the torpedo, without illustration or details provided on the mounting arrangement.

U.S. Pat. No. 5,100,078 to Clark describes a method and apparatus for controlling optical fiber payout from the inside of a wound package of optical fiber. A fiber optic bundle is wound for inside payout and is provided with a housing, with flanges, which maintains compressive force on the windings, and the payout of optical fiber is controlled by a substantially cylindrical mandrel placed in the interior of the inside payout spool. The mandrel supports a small-diameter tube through which the optical fiber pays and places drag on the optical fiber. The drag placed on the optical fiber passing through the small-diameter tube may be increased by slightly bending the tube. The combination of mandrel and small-diameter tube combine to hold the fiber coils in place and supply a certain amount of payout on the optical fiber. According to this teaching, the entire bundle or package may be carried, in a manner left undescribed in any detail, by a projectile or a traveling vehicle, or the package may be maintained at a ground station which may be a vehicle. Also, the end of the optical fiber that pays out through the outlet end of the package may be carried by a traveling vehicle, projectile, or missile, and the like.

None of the above address the problems of providing for guidance cable carried and protected by the torpedo, integrations with the propulsor system, replacement and servicing of the cable and spool without infrastructure.

SUMMARY OF THE INVENTION

It is therefore an object of the present invention to provide a control line spool for an underwater vehicle that facilitates installation and replacement of the spool without requiring substantial disassembly of the vehicle.

It is another object of the invention to provide an arrangement in which a guidance cable spool carried by a controlled vehicle can be replaced and serviced without the need for cumbersome and costly infrastructure in the launch vessel.

In order to accomplish these and other objects of the invention, the present invention allows the control line spool to be externally replaced, relative to the underwater vehicle, without need of disassembling the hull of the vehicle, by combining the spool with the components of the torpedo propulsor system. In one aspect, the stator component of the propulsor system is provided with a spool bucket compartment which houses the control line spool, with access to and removal of the control line spool easily provided by means of a removable cover positioned and releasably fitted onto a mouth or entrance formed at the aft end of the stator in communication with the spool bucket.

Therefore, the spool can be easily installed and replaced without disturbing the principal structural components of the underwater vehicle, such as the hull. This invention thus allows the spools to be replaced without requiring a major redesign of the confines of a submarine to accommodate cumbersome torpedo handling equipment for spool installation/replacement. The integral control wire spool and propulsor arrangement of this invention is easily supported aboard all existing submarines. This invention represents a cost effective solution for replacements of control wire spools.

Also, the invention provides the advantage that the control wire can be coaxially dispensed from a hollowed stator to thereby prevent fouling of the propeller and protect the control wire. Also, the control wire is dispensed in the present invention without interfering with the trim of the torpedo.

BRIEF DESCRIPTION OF THE DRAWING

A more complete understanding of the invention and many of the attendant advantages thereto will be readily appreciated as the same becomes better understood by reference to the following detailed description when considered in conjunction with the accompanying drawing wherein:

The FIGURE illustrates a cross-sectional view of an integral control line spool and propulsor arrangement used in an underwater vehicle in accordance with the invention.

DESCRIPTION OF THE PREFERRED EMBODIMENT

Referring now to the drawing, there is shown a an integral control line spool and propulsor arrangement 10 located at the aft end or stern 22 of an underwater vehicle 20. The underwater vehicle 20, referred to herein occasionally as a torpedo for sake of illustration only and not limitation, has a streamlined hull 23 having a generally elongated tubular shape, which necks down to form a truncated conical shape at its stern 22. At the stern there is a propeller 19 enclosed within a tubular protective shroud 21. The propeller 19 of the propulsor is maintained within a propulsor stator 17 and the shroud 21. The stator 17 has strut portions 32 which extend generally perpendicularly to drive shaft 26. A hollow compartment 29 extends coaxially within shaft 26 and opens rearwardly at the stern of torpedo 20. The propeller 19 is mounted near the stern end of propeller drive shaft 26, and driven rotationally thereby. Although not shown in the FIGURE, it will be understood that an arrangement of counterrotating propellers known in the art also can be used.

The shroud 21 is generally coaxial with said hull 23 and concentric with the frustoconical stern 22 of the hull 23. The shroud 21 is spaced from the drive shaft 26 and propeller 19 an adequate distance to permit the propeller 19 to rotate without encountering obstruction from the shroud 21. Several radial struts 24 connect the shroud 21 to the stern 22. Among other things, the shroud 21 protects the propeller 19. It also effectively prevents the propeller 19 from severing and entangling on board control line 18, which is run through shroud 21, as shown in the FIGURE. The shroud 21 is also connected to stator 17, such as by use of bolts. The on board control line 18 can be an optical fiber or an insulated electrical wire. Alternatively, the control line 18 can be run fixedly along an exterior surface of the shroud 21.

A control line spool 12 is housed in a stationary manner in a spool bucket 27. The spool bucket 27 has an opening which opens toward the stern of the torpedo (i.e., aft end 22). The spool bucket 27 is disposed in hollow compartment 29 located within shaft 26. No direct contact occurs between spool bucket 27 and walls of compartment 29.

A deployable control line 11 is the guidance signal transmission means between the launch vessel and the torpedo, which, for example, can be an optical fiber, or an insulated metal wire capable of transmitting an electrical impulse or current. Deployable control line 11 is wrapped internally in a control line spool canister 12. The interior of bucket 27 and control line spool 12 is normally flooded with sea water when the torpedo 20 is launched. The innermost end 13 of the control line 11 extends through an aperture in the outer wall of the canister 27 and terminates in a water-tight connector 14. On board control line 18 extends from water-tight connector 14 to control and steering means on board the torpedo (not shown) which do not form part of the present invention and, together with means for signaling over the control line are not critical to the practice of the invention. Control line 18 conveys guidance signals and commands delivered to the torpedo via deployable control line 11 to control and steering means located on board the torpedo 20. As to on board control line 18 and the control and steering means, it is only necessary to recognize that torpedo 20 embodies a number of hydrodynamic control surfaces (such as fins) by means of which it may be guided through water toward a target following its launch pursuant to commands or signals transmitted or telemetered to the torpedo from a launch vessel through deployable control line 11.

Now considering the integral control line spool and propulsor arrangement of the invention in greater detail, the stator 17 is provided with a spool bucket 27 in its aft end. Preferably, the spool bucket 27 is arranged coaxially with drive shaft 26. Most preferably, stator 17 is effectively "hollowed-out" to provide a recess or compartment available to receive and hold control line spool 12. To form the spool bucket 27, the stator 17 can be formed as a solid cylinder, and the recess drilled out, or alternatively, the stator 17 can be cast in a configuration including the recess for spool bucket 27. Generally, the inner walls defining the spool bucket 27 will be smooth in texture.

There is a cover 15 having a central payout hole 16 therein that is positioned on and releasably secured to the aft end of the stator 17 by conventional means, such as clips or threading (not shown), to retain control line spool 12 in place in the spool bucket 27. Spool bucket 27 terminates in an entrance opening 30 at the aft end of stator 17. Entrance opening 30 can be threaded about the lip 31 of opening 30 to allow cover 15 to be threaded and threadably engaged in entrance opening 30.

Diametric and length clearance between the outer wall of spool 12 and the inner walls of the spool bucket 27 in stator 17 preferably are sized such that the spool canister 12 can be inserted into and retracted from the spool bucket 27 without undue difficulty by providing clearance for the spool 12 in length and diametric dimensions, while making it snugly-fitting enough to prevent the spool 12 from rattling within the spool bucket 27.

Payout of the deployable control wire 11 is from the aft end. 22 of the stator 17, which is also the aft end of the underwater vehicle 20. The segment length of the deployable control line 11 payed out of the control line spool 12 is indicated in the FIGURE as line 28. The payout hole 16 should be large enough to accommodate a connector on the outermost end (not shown) of the payed out length of control line 11. The outermost end (not shown) of the external length 28 of the control line is connected to a guidance control system located on board the launch vessel, such as via a connection located within a torpedo tube. The total length of the deployable control line 11 gives the torpedo 20 its range of action. In this integral control line spool and propulsor arrangement of this invention the control line can be coaxially dispensed from a hollowed stator 17 to thereby prevent fouling of the propeller 19 and protect the on board, stored control line 11 as well as the dispensed control wire 28. Also, the control line is dispensed in the present invention without interfering with the trim of the torpedo.

To replace the control line spool 12, the cover 15 is removed (such as by unscrewing threads or releasing mechanical clips, or the like) to provide access to the spool 12. Then, the old or spent control line spool 12 is removed from the spool bucket 27 of the stator 17 and unplugged from connector 14. Then, a new connector attached to a free end of a new control line spool 12 is plugged into the connector 14 positioned in the stator 17, and the new control line spool then is inserted inside the spool bucket 27. The trailing end of the new control line is inserted through the payout hole 16 of cover 15, and the cover 15 refitted onto the stator 17. At this point, the new control line is fixed in position within spool bucket 27 to form an integral spool and propulsor system 10. The torpedo 20 can then be loaded for launching, and the outer end of the external segment length 28 of the control line 11 can be plugged inside the torpedo tube to allow communication with control means on board the launch vessel.

In view of the foregoing, it is seen that the invention provides an integral spool and propulsor system arrangement which permits straightforward replacement of the spool without requiring disassembly of the hull of the underwater vehicle nor requiring cumbersome torpedo handling equipment.

In light of the above, it is therefore understood that within the scope of the appended claims, the invention may be practiced otherwise than as specifically described.

What is claimed is:

1. A control line deployment device for an underwater vehicle comprising:

a stator positioned at the aft end of said underwater vehicle having a spool bucket formed therein with an entrance opening at an aft end of said stator in communication with said spool bucket;

a control line spool slidably disposed in said spool bucket; and a control line in communication with said underwater vehicle and wound upon said control line spool, said control line being deployable from said control line spool by extension through said entrance opening.

2. The device of claim 1 further comprising a cover means removably attached to said stator covering said entrance opening, said cover having a control line deployment aperture formed therein.

3. The device of claim 2 further comprising:

an underwater vehicle connector disposed on said stator;

a proximate control line connector joined to said control line at said end of said control line being deployed;

a distal control line connector joined to said control line at an end of said control line being deployed.

4. The device of claim 1 wherein said stator has a propeller shroud integrally formed therewith.

5. The device of claim 4 further comprising a drive shaft with a forward end, an aft end, and a cavity formed in said drive shaft at the aft end thereof, said stator extending into said cavity, there being clearance between said stator and said drive shaft.

6. The device of claim 5 further comprising at least one propeller mounted on said drive shaft aft end, said shroud surrounding said at least one propeller.

7. The device of claim 3 wherein said cover means is releasably fitted onto said entrance opening by a fastening means selected from the group consisting of fastening clips and a screwable cover lid.

8. The device of claim 3 wherein said control line comprises a material selected from the group consisting of an insulated metal wire and an optical fiber.

* * * * *